United States Patent [19]

Sask et al.

[11] Patent Number: 4,995,462

[45] Date of Patent: Feb. 26, 1991

[54] DEWAXING CONTROL APPARATUS FOR OIL WELL

[75] Inventors: David Sask; Marcel Obrejanu; Allen Grimshaw, all of Calgary, Canada

[73] Assignee: Maralda Oilwell Technology Ltd., Calgary, Canada

[21] Appl. No.: 502,402

[22] Filed: Mar. 30, 1990

[30] Foreign Application Priority Data

Sep. 29, 1989 [CA] Canada ..... 614434

[51] Int. Cl.[5] ..... E21B 37/06; E21B 34/10

[52] U.S. Cl. ..... 166/304; 166/332

[58] Field of Search ..... 166/304, 312, 68.5, 166/105, 105.5, 106, 325, 332

[56] References Cited

U.S. PATENT DOCUMENTS

| | | | |
|---|---|---|---|
| 2,394,189 | 2/1946 | Kaufman . | |
| 2,704,979 | 3/1955 | Willigen . | |
| 3,014,531 | 12/1961 | Weaver | 166/304 X |
| 3,361,205 | 1/1968 | Waldron . | |
| 3,376,936 | 4/1968 | Tomlin | 166/304 X |
| 4,011,906 | 3/1977 | Alexander et al. | 166/105 |
| 4,049,057 | 9/1977 | Hewes | 166/304 |
| 4,224,993 | 9/1980 | Huckaby | 166/325 |
| 4,681,167 | 7/1987 | Soderberg | 166/371 |
| 4,771,831 | 9/1988 | Pringle et al. | 166/332 X |
| 4,791,985 | 12/1988 | Bermudez | 166/68 |
| 4,915,175 | 4/1990 | Mashaw, Jr. | 166/332 |

*Primary Examiner*—William P. Neuder

*Attorney, Agent, or Firm*—Mirek A. Waraksa

[57] ABSTRACT

Dewaxing control apparatus is adapted for use in a well casing containing a production tubing string defining an annulus within the well casing and a down hole pump which pumps oil upwardly through the production tubing. The apparatus has a housing adapted to be installed in-line with the production tubing. A passage in the housing places the annulus in communication with the interior of the production tubing for purposes of circulating a hot dewaxing oil. A cup packer positioned below the passage closes the annulus against downward liquid flows. A gas by-pass passage in the housing permits gases to be exhausted upwardly through the annulus during oil production despite the presence of the packer. A valve mechanism responsive to pressure developed by pumping hot dewaxing oil down the annulus closes the gas by-pass passage and opens the liquid transfer passage so that the dewaxing oil can flow into the production tubing and back up to the surface. Flow of dewaxing oil into the oil-bearing formation is prevented.

8 Claims, 3 Drawing Sheets

DEWAXING CONTROL APPARATUS FOR OIL WELL

FIELD OF THE INVENTION

The invention relates to apparatus for use in dewaxing production tubins strings in a well casing.

BACKGROUND OF THE INVENTION

During production of oil from an underground geological rock formation, it is fairly common for paraffin, a naturally occurring constituent of crude oil, to precipitate. Where the wax deposition occures depends on several factors, but is mainly influenced by temperature. There is a distinct tendency, however, for the wax to precipitate in upper portions of the production tubing string. Such precipitation progressively decreases oil production, and eventually plugs the production tubing, stopping oil production entirely.

Removal of wax from a production tubing string is generally accomplished by one of severa methods: mechanical removal (scraping or cutting); use of solvents to dissolve the wax; use of chemical dispersants; and the use of heat to melt the wax. A common practice in wells which use a sucker rod pump to raise oil to the earth's surface is to circulate a hot dewaxing fluid, usually oil, in the well. This is often done by pumping the dewaxing liquid down the annulus, through the pump, and back up the production tubing to the surface. Alternatively, the pump may be unseated, and hot fluid may be pumped down the tubing, around the pump, and back up the annulus to the surface.

Use of such methods in low pressure reservoirs (where wax problems are often most severe) is particularly unsatisfactory. The formation may not be capable of supporting the hydrostatic pressure of a full column of oil in the annulus. In such cases, the hot dewaxing oil is lost into the reservoir and often carries with it wax which has been melted from the production tubing. It is not uncommon for 300 barrels or more of such hot oil to be lost into the reservoir together with melted wax during such dewaxing. The wax removed from the production tubing ends to precipitate in the pores of the rock formation if the reservoir temperature is low enough, an after repeated hot oil treatments, there can be very substantial loss of production. Removal of the wax deposited in the formation can be extremely difficult and costly. Production is also significantly imparied since periods of up to 15 days may be required to pump the fluid originally lost in the hot oil treatment, from the reservoir.

BRIEF SUMMARY OF THE INVENTION

In one aspect, the invention provides dewaxing control apparatus adapted for use in the well string containing a production tubing string defining a annulus within the well casing and containing a down hole pump which pumps oil in a lower portion of the well annulus up through the production tubing. The dewaxing control apparatus comprising a housing adapted to be installed in-line with the production tubing and having a passage with a first end at the annulus and a second end at the interior of the production tubing. Valve means are selectively operable to allow transfer of liquids along the passage between the annulus and interior of the production tubing and to close the passage against such liquid flows. Packer means mounted on the housing permit the annulus to be closed against downward flow of liquids at a position below the first end of the passage. During oil production, the passage in the valve housing a maintained in a closed state. When dewaxing is required, the passage is opened and a dewaxing fluid is circulated through the annulus (above the packer means) and the production tubing string to remove was deposits. The oil-producing geological formation is effectively isolated from the dewaxing flows so that no significant quantities of wax-laden liquids are forced into the formation.

Gases are normally liberated into the well annulus during oil production and are exhausted at the earth's surface. It is undesirable to permit or constrain such gases fo flow upwardly through the down hole pump whose operation would normally be adversely affected by the presence of gases. It is, however, relatively costly to provide an inflatable packer or other active packing means and associated actuators which would permit gas exhaustion in the annulus during production, yet permit closing of th annulus when a column of liquid must necessarily be formed in the annulus during dewaxing operations. Accordingly, in another aspect, the invention provides dewaxing control apparatus comprising a housing adapted to be installed in-line with the production tubing string and having a liquid transfer passage with a first end at the annulus and a second end at the interior of the production tubing. A passive packer is mounted on the housing below the first end of the liquid transfer passage to close the annulus below the first end of the liquid transfer passage. The term "passive packer" as used herein should be understood as meaning a device such as a cup packer, and elemental packer which requires only an initial compression to assume a sealing state or the like, which closes an annulus in a relatively permanent manner rather than requiring continued or periodic actuation to do so. A gas by-pass passage is provided which has a lower end communicating with the annulus below the packer and an upper end communicating with the annulus above the packer thereby circumventing the packer for purposes of gas transfer. Controllable valve means (preferably responsive to pressure differentials created between the annulus and the interior of the production tubing, as when dewaxing fluid is pumped under pressure) are operable to assume first and second states. In the first state, the valve means close the liquid transfer passage against transfer of liquids between the annulus and the interior of the production tubing but allow transfer of gases upwardly along the by-pass passsage. In the second state, the valve means close the by-passage against downward transfer of liquids, but allow transfer of liquids along the liquid transfer passage between the annulus and the interior of the production tubing string. Accordingly, during production, the valve means can be made to assume their first state, and production gases are allowed to flow upwardly through the annulus, by-passing the packer by flowing through the by-pass passage. When dewaxing operations are required, the valve means are made to assume their second state, closing the by-pass passage against possible downward flow of dewaxing liquids forming a column in the annulus. The controllable valves means may be constituted by a single valve mechanism, as in the preferred embodiment described below, but may in fact involve separate valve mechanisms individually operating on the liquid transfer passage and the gas by-pass passage.

In preferred form, the valve means respond to an excess of pressure in the annulus relative to pressure in the interior of the production tubing by assuming the second valve state appropriate for dewaxing operations. Accordingly, dewaxing fluid can be pumpted down the annulus with sufficient pressure to effectively cause opening of the liquid transfer passage and can be circulated into and up the production tubing. The advantage of such an arrangement is that wax, which in practice deposits primarily in the upper portions of the production tubing, is not entrained with the dewaxing fluid downwardly through the production tubing and into the annulus. Precipitation of removed wax can instead be avoided by immediate removal at the earth's surface.

Other aspects of the invention will be apparent from the description below of preferred embodiment and will be more specifically defined in the appended claims.

DESCRIPTION OF THE DRAWINGS

The invention will be better understood with the reference to drawings in which.

DESCRIPTION OF PREFERRED EMBODIMENT

Figure 1:
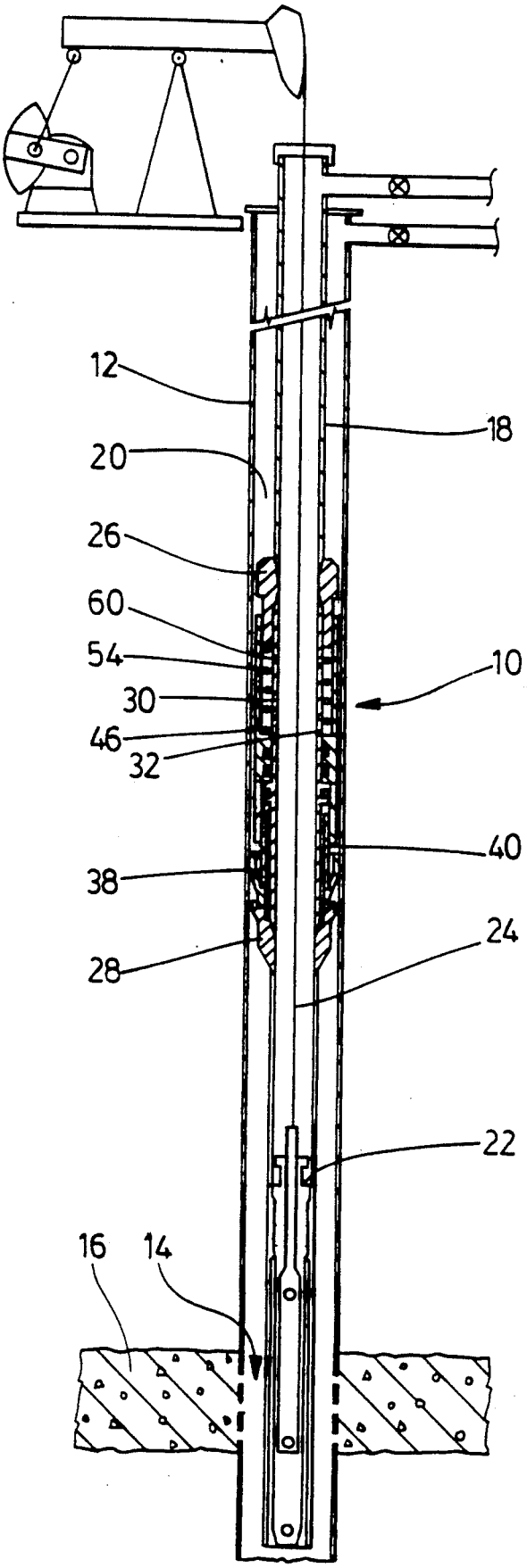
FIG. 1 is a schematic representation of a well being produced with a sucker rod pump and comprising dewaxing apparatus embodying the invention.
Figure 2:
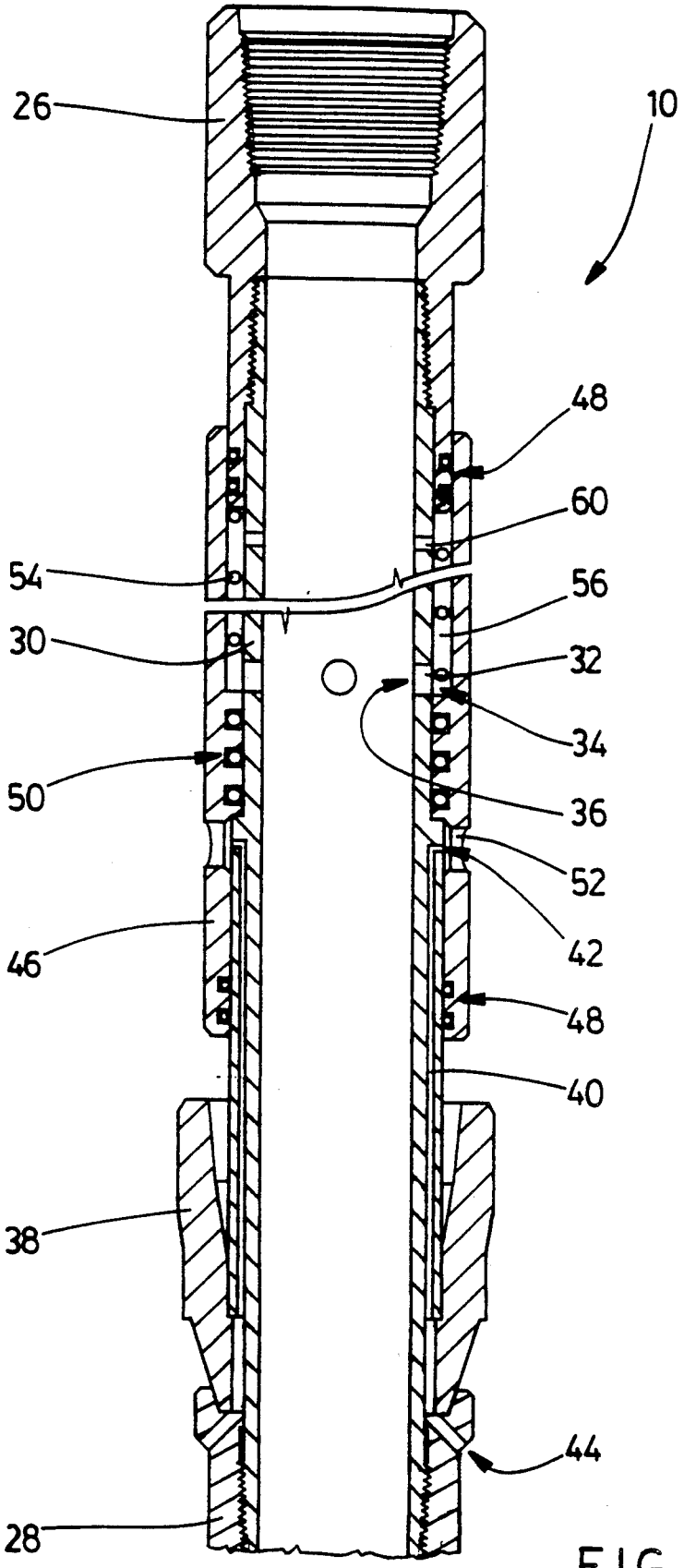
FIG. 2 is cross-sectional view in a vertical plane through the apparatus; and, FIGS. 3*a* and 3*b* are sectional views of the apparatus showing respectively a valve state appropriate for dewaxing operations and another valve state appropriate for production.

Reference is made to FIG. 1 which illustrates a well incorporating dewaxing control apparatus 10 embodying the invention. A well casing 12 is cemented into a wellbore. The casing 12 is perforated at 14 adjacent to the rock formation 16 of interest to allow oil and other formation fluids to flow into the casing 12. The well casing 12 contains a production tubing string 18 which defines an annulus 20 within the well casing. A down hole pump 22 is located in a conventional manner within the production tubing 18 proximate to the formation 16. The pump 22 is operated from the surface in a conventional manner with a sucker rod line 24. The production tubing 18 may be anchored in a conventional manner to withstand the action of the pump 22.

The apparatus 10 has a housing installed in-line with the production string. The apparatus 10 should be located at a position below the lowest point where wax deposition is expected to occur in the production tubing 18. This is preferably as close to the pump 22 as conveniently possible, to ensure that all deposited wax can be removed from the production tubing 18. It is preferable to have the apparatus 10 positioned above the normal liquid level of the well to allow for better gas separation. Movement of gas will be described more fully below.

The housing comprises top and bottom subassemblies 26, 28 adapted for installation in the production tubing 18 in a conventional manner. These are joined by a mandrel 30. A liquid transfer passage 32 is formed in the mandrel 30 for purposes of passing dewaxing liquid from the annulus 20 to the interior of the production tubing 18. The liquid passage 32 has one end 34 at the annulus 20 and another end 36 at the interior of the production tubing 18. A cup packer 38 is mounted on the mandrel 30 below the passage end 34 at the annulus 20. The cup packer 38 is dimensioned to close the annulus 20 to prevent downward flow of liquids at a point below the passage end 34. A gas by-pass passage 40 is formed in the mandrel 30 and the bottom subassembly 28. It has an upper end 42 at the exterior surface of the housing mandrel 30 above the packer 38 and a lower end 44 at the exterior of the bottom subassembly 28.

Figure 3B:
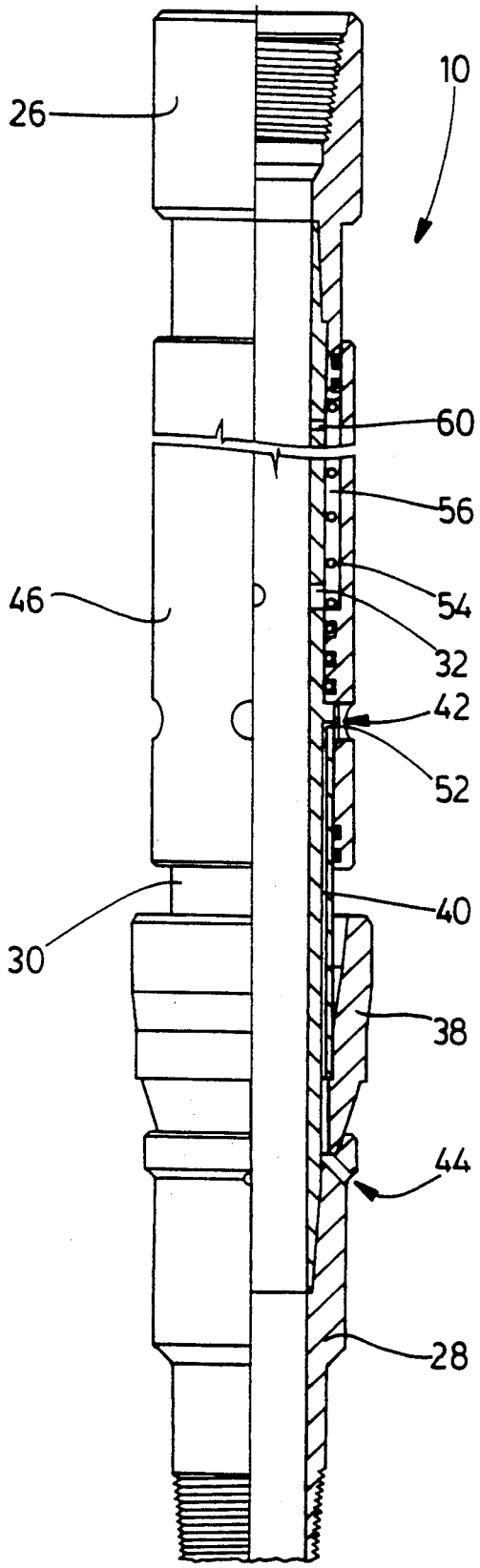
Figure 3A:
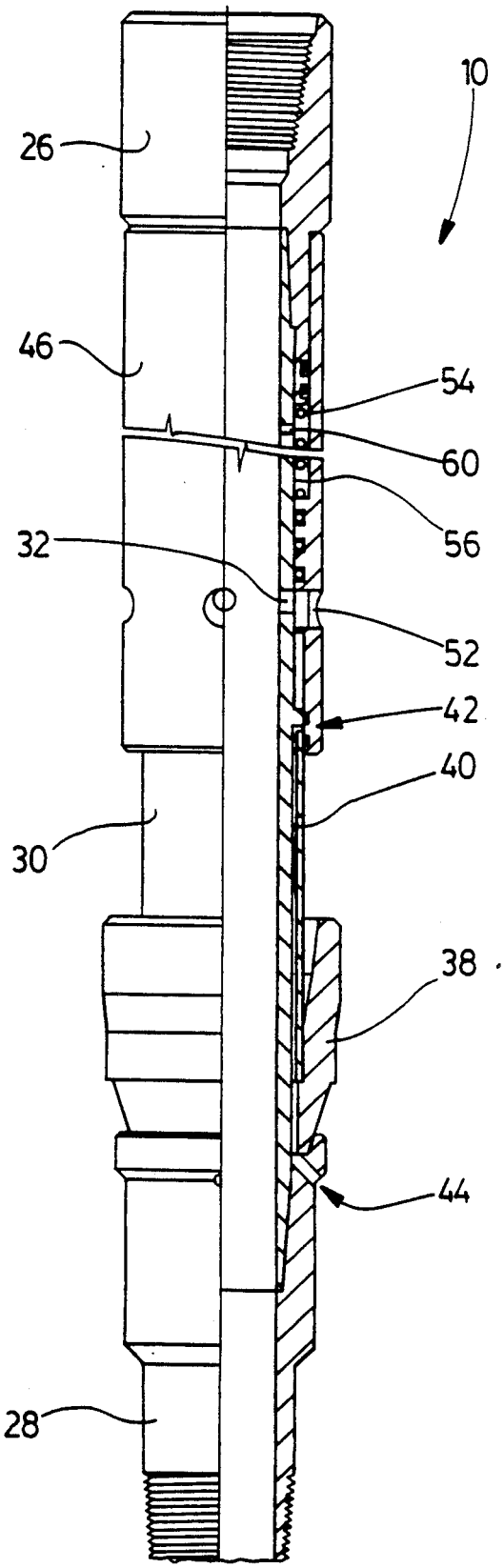

Liquid and gas flows are very conveniently controlled in this embodiment of the invention by a single flow gating member. This is a sleeve 46 mounted on the exterior of the mandrel 30. Upper and lower sections of the sleeve 46 are sealed to the exterior surface of the mandrel 30 with O-rings 48 seated in appropriate annular seating surfaces. An intermediate section is also sealed to the mandrel 30 with O-rings 50. The sleeve 46 has an aperture 52 which is vertically aligned with the first end 34 of the liquid transfer passage 32 and with the upper end 42 of the gas by-pass passage 40. The sleeve 46 is mounted for movement between an upper position illustrated in FIG. 3*a* (a dewaxing position) and a lower position illustrated in FIG. 3*b* (a production position). The aperture 52 registers with open ends 34 42 of the liquid transfer and gas by-pass passages 32, 40 to enable fluid flow in one passage at a time. In a production position, the sleeve 46 closes the liquid transfer passage 32 against liquid flow between the annulus 20 and the interior of the production tubing 18, but the aperture 52 then registers with the upper end 42 of the gas by-pass passage to permit gas flow upwardly around the packer 38. In the dewaxing position, the sleeve 46 closes the gas by-pass passage 40 against downward flow of the column of liquid which will be accumulated in the annulus 20, but the aperture 52 then registers with the first end 34 of the liquid transfer passage 32 to permit liquid flow between the annulus 20 and the interior of the production tubing 18.

A spring 54 is located about the mandrel 30 in a chamber 56 defined between the inner surface of the sleeve 46 and an outer surface of the mandrel 30. The spring 54 acts between the bottom surface of the top subassembly 26 and an internal rib 58 to urge the sleeve 46 normally to its lower, production position. The chamber 56 is vented to the interior of the production tubing 18 by a channel 60 and is consequently subject to the internal pressure of the liquids in the production tubing 18. An excess of pressure in the annulus 20, however, will displace the sleeve 46 upwardly to the dewaxing position even against the operation of the spring 54 and internal pressure. In that regard, it should be noted that internal pressure exerts a downward force on the sleev 46 proportional to an effective cross-sectional area bounded by the outer diameter of the mandrel 30 and the inner diameter of the sleeve 46 immediately above the rib 58. Pressure in the annulus 20 exerts an upward force proportional to a net effective cross-sectional area also bounded substantially by the outer diameter of the mandrel 30 and the inner diameter of the sleeve 46 at the aperture 52. Accordingly, if a dewaxing fluid is pumped with sufficient pressure down the annulus 20, the sleeve 46 will be displaced by the dewaxing fluid to its upper dewaxing positon and the dewaxing fluid will flow through the liquid transfer passage 32 into the interior of the production tubing 18 and back up to the surface.

The operation of the dewaxing control apparatus 10 will be apparent from the foregoing description of its components and will be only briefly described. During production, the sleeve 46 is maintained in its production position by the spring 54 and the column of oil in the production tubing 18. The liquid trnasfer passage 32 is closed and oil is simply pumped up the production tubing 18. Gases escape upwardly through the open by-pass passage 40. To dewax the production tubing 18, pumping is stopped and hot dewaxing fluid is pumped from the surface down the annulus 20 at pressure sufficient to displace the sleeve 46 upwardly to its dewaxing position. This opens the liquid transfer passage 32 permitting the hot dewaxing fluid to flow into the interior of the production tubing 18 and upwardly to the surface. The sleeve 46 simultaneously closes the by-pass passage 40 preventing the column of dewaxing fluid accumulated above the packer 38 from flowing downwardly through the by-pass passage 40 into the formation 16. Accordingly, no significant fluid flow into the oil-bearing formation 16 occurs during the dewaxing process.

The valve means of this embodiment of the invention respond to an excess of pressure in the annulus 20 over pressure in the interior of the production tubing 18. It should be readily apparent to those skilled in the art that the valve mechanism described herein can be incorporated into the interior of the housing, making the valve means responsive to an excess of pressure in the interior of the production tubing 18 thereby permitting pumping of dewaxing fluid down the production tubing 18 and upwardly through the annulus 20. However, the arrangement illustrated is strongly preferred, as this tends not to contaminate the entirety of the annulus 20 and lower portions of the production tubing 18 with wax entrained with the dewaxing fluid flows.

In the foregoing description of the dewaxing control apparatus 10, only a single by-pass passage 40, liquid transfer passage 32, and sleeve 46 aperture 52 have been identified. It should be noted, however, that there are in fact four of each, equally spaced circumferentially about the housing, substantially identical and effectively operating in parallel.

It will be appreciated that a particular embodiment of the invention has been described and that modifications may be made therein without departing from the spirit of the invention or necessarily departing from scope of the appended claims.

We claim:

1. Dewaxing control apparatus for use in a well casing containing a tubing string which defines an annulus within the well casing and containing a down hole pump which pumps oil in a lower portion of the well annulus up through the interior of the tubing string, the dewaxing control apparatus comprising:

a housing having a liquid transfer passage and adapted to be installed in-line with the tubing string above the pump with a first end of the liquid transfer passage communicating with the annulus and a second end of the liquid transfer passage communicating with the interior of the tubing string;

packer means mounted on the housing for closing the annulus against downward flow of liquids at a position below the first end of the liquid transfer passage;

means defining a gas by-pass passage with an upper end positioned to communicate with the annulus above the packer means and a lower end positioned to communicate with the annulus below the packer means;

valve menas for regulating fluid flows along the liquid transfer and gas by-pass passages and operable to assume first and second states, the valve means in the first state closing the liquid transfer passage against transfer of liquids between the annulus and the interior of the tubing string and allowing transfer of gases upwardly along the gas by-pass passage, the valve means in the second state allowing transfer of liquids along the liquid transfer passage between the annulus and the interior of the tubing string and closing the gas by-pass passage against downward flow of liquids.

2. the dewaxing control apparatus of claim 1 in which the valve means comprise:

a flow gating member;

means mounting the flow gating member to the housing for movement between a first position in which the flow gating member closes the liquid transfer passage against liquid flow between the annulus and the interior of the tubing string and allows gas flow upwardly along the gas by-pass passage and a second position in which the flow gating member closes the gas by-pass passage against downward flow of liquid and allows liquid flow along the liquid transfer passage between the annulus and the interior of the tubing string.

3. The dewaxing control apparatus of claim 2 in which the valve means comprise means for urging the flow gating member normally to its first position and means for displacing the flow gating member to its second position in response to an excess of pressure in a predetermined one of the annulus and the interior of the tubin string relative to the other of the annulus and the interior of the tubing string.

4. The dewaxing control apparatus of claim 2 in which the valve means comprise means for urging the flow gating member normally to its first position and means for displacing the sleeve to its second position in response to an excess of pressure in the annulus relative to pressure in the interior of the tubing string whereby a dewaxing liquid delivered under sufficient pressure down the annulus displaces the flow gating member to its second position and flows into the interior of the tubing string.

5. The dewaxing control apparatus of claim 4 in which:

the gas by-pass passage is formed in the housing and has its upper and lower ends at an exterior surface of the housing;

the flow gating member comprises a sleeve located about the exterior of the housing and having an aperture, the aperture being positioned on the sleeve to register with the upper end of the gas by-pass passage when the flow gating member is in its first position and with the first end of the liquid transfer passage when the flow gating member is in its second position such that fluid flow is disabled along one of the gas by-pass and liquid transfer passages whenever fluid flow is enabled along the other of the gas by-pass and liquid transfer passages.

6. The dewaxing apparatus of claim 1 in which the packer means comprise a passive packer.

7. The dewaxing apparatus of claim 1 in which the gas by-pass passage is formed in the housing.

8. Dewaxing control apparatus for use in a well casing containing a tubing string which defines an annulus within the well casing and containing a down hole pump which pumps oil in a lower portion of the well annulus up through the interior of the tubing string, the dewaxing control apparatus comprising:

a housing having a liquid transfer passage and adapted to be installed in-line with the tubing string above the pump with a first end of the liquid transfer passage communicating with the annulus and a second end of the liquid transfer passage communicating with the interior of the tubing string;

a passive packer mounted on the housing and adapted to close the annulus against downward flow of liquids at a position below the first end of the liquid transfer passage;

a gas by-pass passage formed in the housing, the gas by-pass passage having an upper end positioned to communicate with the annulus above the packer and a lower end positioned to communicate with the annulus below the packer;

valve means for regulating fluid flows along the liquid transfer and gas by-pass passages, the valve means comprising:

a. a sleeve;

b. means sealing the sleeve to the exteior of the housing and permitting sliding movement of the sleeve between first and second positions on the housing;

c. an aperture positioned on the sleeve to register with the upper end of the gas by-pass passage when the sleeve is in its first position and with the first end of the liquid transfer passage when the sleeve is in its second position such that fluid flow is disabled along one of the gas by-pass and liquid transfer passages whenever fluid flow is enabled along the other of the gas by-pass and liquid transfer passages;

d. means for urging the sleeve normally to its first position;

e. means for displacing the sleeve to its second position in response to an excess of pressure in the annulus relative to pressure in the interior of the tubing string whereby a dewaxing liquid delivered under sufficient pressure down the annulus displaces the sleeve to its second position and flows into the interior of the tubing string.

* * * * *